US010375462B2

(12) United States Patent
Liu et al.

(10) Patent No.: US 10,375,462 B2
(45) Date of Patent: Aug. 6, 2019

(54) SILICA GEL DIAPHRAGM, RECEIVER MODULE, AND METHOD FOR PROCESSING SILICA GEL DIAPHRAGM

(71) Applicant: GOERTEK INC., Weifang (CN)

(72) Inventors: Chunfa Liu, Weifang (CN); Xiaodong Guo, Weifang (CN)

(73) Assignee: Goertek Inc., Weifang, Shandong Province (CN)

( * ) Notice: Subject to any disclaimer, the term of this patent is extended or adjusted under 35 U.S.C. 154(b) by 0 days.

(21) Appl. No.: 15/552,963

(22) PCT Filed: Dec. 18, 2015

(86) PCT No.: PCT/CN2015/097963

§ 371 (c)(1),
(2) Date: Aug. 23, 2017

(87) PCT Pub. No.: WO2016/169283

PCT Pub. Date: Oct. 27, 2016

(65) Prior Publication Data

US 2018/0035191 A1 Feb. 1, 2018

(30) Foreign Application Priority Data

Apr. 23, 2015 (CN) ..... 2015 1 0204167

(51) Int. Cl.
*H04R 1/10* (2006.01)
*H04R 7/18* (2006.01)
(Continued)

(52) U.S. Cl.
CPC ..... *H04R 1/10* (2013.01); *H04R 7/06* (2013.01); *H04R 7/18* (2013.01); *H04R 9/02* (2013.01);
(Continued)

(58) Field of Classification Search
CPC ... H04R 7/18; H04R 7/20; H04R 9/00; H04R 9/02; H04R 31/00; H04R 7/16; H04R 31/003; H04R 9/06
See application file for complete search history.

(56) References Cited

U.S. PATENT DOCUMENTS 10,091,570 B2 * 10/2018 Xiao ..... H02K 41/0356
2009/0268928 A1 * 10/2009 Ikeyama ..... C09J 7/25 381/150
(Continued)

FOREIGN PATENT DOCUMENTS

CN 2459842 Y 11/2001
CN 103024638 A 4/2013
(Continued)

OTHER PUBLICATIONS

International Search Report (PCT/ISA/210) dated Feb. 2, 2016, by the Chinese Patent Office as the International Searching Authority for International Application No. PCT/CN2015/097963.
(Continued)

*Primary Examiner* — Fan S Tsang
*Assistant Examiner* — Angelica M McKinney
(74) *Attorney, Agent, or Firm* — Buchanan Ingersoll & Rooney PC

(57) ABSTRACT

A silica gel diaphragm, a receiver module, and a method for processing a silica gel diaphragm. Two metal pieces are integrally injection-molded on the diaphragm, and symmetrically embedded into the diaphragm, and either end of each of the metal pieces is provided with first and second soldering portions; each of the first soldering portions is embedded into a planar portion of the diaphragm, and is used for soldering a winding tap of a voice coil on an inner side of the voice coil; each of the second soldering portions protrudes from or is embedded into the fixing portion of the diaphragm, and is used for soldering a bonding pad on a
(Continued)

housing; and middle portions connecting the first soldering portions and the second soldering portions are embedded into the diaphragm to form an electrically conductive path. This technical solution increases the product stability.

13 Claims, 2 Drawing Sheets

(51) Int. Cl.

| | |
|---|---|
| ***H04R 31/00*** | (2006.01) |
| ***H04R 7/06*** | (2006.01) |
| ***H04R 9/02*** | (2006.01) |
| *H04R 9/06* | (2006.01) |

(52) U.S. Cl.
CPC ..... *H04R 31/00* (2013.01); *H04R 31/003* (2013.01); *H04R 9/06* (2013.01); *H04R 2231/001* (2013.01)

(56) References Cited

U.S. PATENT DOCUMENTS

2012/0213398 A1* 8/2012 Itoh ..... H04R 9/025 381/334
2013/0016874 A1* 1/2013 Huang ..... H04R 9/043 381/433
2015/0181345 A1* 6/2015 Cai ..... H04R 9/06 381/412
2015/0256939 A1* 9/2015 Zhao ..... H04R 9/06 381/116
2017/0347204 A1* 11/2017 Linghu ..... H04R 1/2807

FOREIGN PATENT DOCUMENTS

| | | | |
|---|---|---|---|
| CN | 103152679 | A | 6/2013 |
| CN | 203675306 | U | 6/2014 |
| CN | 104853304 | A | 8/2015 |
| EP | 1 768 448 | A2 | 3/2007 |
| JP | 2003-199193 | A | 7/2003 |

OTHER PUBLICATIONS

Written Opinion (PCT/ISA/237) dated Feb. 2, 2016, by the Chinese Patent Office as the International Searching Authority for International Application No. PCT/CN2015/097963.
Office Action dated May 12, 2017, by the Chinese Patent Office for Application No. 201510204167.4.
Extended European Search Report dated Oct. 17, 2018 in corresponding European Patent Application No. 15889763.7.

* cited by examiner

SILICA GEL DIAPHRAGM, RECEIVER MODULE, AND METHOD FOR PROCESSING SILICA GEL DIAPHRAGM

CROSS REFERENCE TO RELATED APPLICATIONS

This application is a national phase of International Application No. PCT/CN2015/097963, filed on Dec. 18, 2015, which is based upon and claims priority to Chinese Patent Application No. 201510204167.4, filed on Apr. 23, 2015, the entire contents of which are incorporated herein by reference.

TECHNICAL FIELD

The present disclosure relates to the technical field of electroacoustic products, and in particular, to a silica gel diaphragm, a receiver module and a method for processing a silica gel diaphragm.

BACKGROUND

The voice coil of the existing receiver modules must be connected to a bonding pad for connecting with the external conductor, so as to receive signals and generate current, and then drive the diaphragm to vibrate to generate sound. Therefore, the voice coil must have lead wires outgoing from the two sides for connecting with the bonding pad. Such segments of lead wires are only used for electric conduction, and they do not only generate extra resistance, but also causes the collision during the vibration to produce noise.

The noise of the receiver module is mainly caused by the collision between the voice coil lead wires and the diaphragm or the housing. In order to reduce the collision with the diaphragm or the housing, it is necessary to improve the control on the outgoing trajectory of the lead wires and provide sufficient vibration space. In order to improve the control on the outgoing trajectory, corresponding control devices certainly have to be added, and thus the cost is increased and the product price rises, which is adverse to the product market competitiveness. If the vibration space is increased, the receiver module is expanded, which easily causes interference during the assembly with other products, while the miniaturization tendency also cannot be satisfied.

SUMMARY

The present disclosure provides a silica gel diaphragm, a receiver module, and a method for processing a silica gel diaphragm, so as to solve the problem of the noise caused by the collision between the voice coil lead wires and the diaphragm or the housing.

In order to achieve the above objective, the technical solutions of the present disclosure are implemented as follows:

In one aspect, the embodiments of the present disclosure provide a silica gel diaphragm, comprising a planar portion located at a center, a folded ring portion disposed at an edge of the planar portion, and a fixing portion connected to the periphery of the folded ring portion for bonding a housing, wherein two metal pieces are integrally injection-molded on the silica gel diaphragm, and symmetrically embedded into the silica gel diaphragm, and either end of each of the metal pieces is provided with a first soldering portion and a second soldering portion; and each of the first soldering portions is embedded into the planar portion of the silica gel diaphragm that is closer to the folded ring portion, and is used for soldering a winding tap of a voice coil on an inner side of the voice coil; each of the second soldering portions protrudes from or is embedded into the fixing portion of the silica gel diaphragm, and is used for soldering a bonding pad on a housing; and middle portions connecting the first soldering portions and the second soldering portions are embedded into the silica gel diaphragm to form an electrically conductive path.

Preferably, the first soldering portions of the two metal pieces are symmetrically disposed at central positions on the planar portion that are closer to the folded ring portion.

Preferably, upper surfaces of the first soldering portions of the two metal pieces are exposed from a lower surface of the silica gel diaphragm; and when the second soldering portions are embedded into the fixing portion of the silica gel diaphragm, upper surfaces of the second soldering portions of the two metal pieces are exposed from the lower surface of the silica gel diaphragm.

Preferably, one end of the middle portions has the same shape as the shape of the folded ring portion and is embedded into the folded ring portion, and other portions of the middle portions are embedded into the fixing portion of the silica gel diaphragm.

In the technical solution, the two metal pieces are integrally injection-molded with the silica gel diaphragm, such that the connection between the voice coil and the bonding pad can be achieved by soldering the metal pieces with the voice coil and the bonding pad, respectively, during the assembly of the voice coil. The solution where the voice coil lead wires are replaced by the two metal pieces of the silica gel diaphragm can solve the problem of the poor audition caused by the collision of the voice coil lead wires in traditional solutions. In addition, the metal pieces injection-molded in the silica gel diaphragm do not occupy any extra space, and can avoid the risk of the breakage of the voice coil lead wires, thereby improving the product stability.

In the technical solution, the silica gel diaphragm of the technical solution has low manufacturing difficulty and high yield. Compared with traditional techniques such as diaphragm surface electroplating and sputtering, the solution where metal pieces are injection-molded into the silica gel diaphragm has the advantage that the conductive metal layer will not easily be fractured or corroded.

In another aspect, the embodiments of the present disclosure provide a receiver module, comprising a vibration system received in a housing, wherein the vibration system comprises a diaphragm and a voice coil combined together, wherein the diaphragm is the silica gel diaphragm provided in the above technical solution; and the voice coil is fixed on an inner side of a folded ring portion of the silica gel diaphragm; the first soldering portions of the two metal pieces of the silica gel diaphragm are soldered with winding taps at two ends of the voice coil, respectively; and the second soldering portions of the two metal pieces are soldered with two bonding pads on the housing, respectively.

In the receiver module of the technical solution, the voice coil lead wires in traditional solutions are replaced by the two metal pieces injection-molded in the silica gel diaphragm, such that the soldering portions at the two ends of either metal piece are soldered with the winding taps of the voice coil and the bonding pads on the housing, respectively, thereby completely solving the problem of the poor audition caused by the collision between the voice coil lead wires and the diaphragm or the housing. Compared with the traditional solution where the voice coil lead wires are used, the technical solution does not only completely solve the problem of the poor audition caused by the collision of the voice coil lead wires, but also simplifies the process flow, reduces difficulty in manufacturing and assembling, improves the test yield of the receiver module, and increases the yield of the receiver module.

In still another aspect, the embodiments of the present disclosure further provide a method for processing a silica gel diaphragm, comprising:

integrally injection-molding liquid silica gel and two metal pieces, which comprise first soldering portions and second soldering portions, such that the two metal pieces are symmetrically embedded into the molded silica gel diaphragm, wherein each of the first soldering portions is embedded into a planar portion of the silica gel diaphragm that is closer to the folded ring portion, and is used for soldering a winding tap of a voice coil on an inner side of the voice coil; each of the second soldering portions protrudes from or is embedded into a fixing portion of the silica gel diaphragm, and is used for soldering a bonding pad on a housing; and middle portions connecting the first soldering portions and the second soldering portions are embedded into the silica gel diaphragm to form an electrically conductive path.

Preferably, the integrally injection-molding liquid silica gel and two metal pieces, which comprise first soldering portions and second soldering portions comprises:

locating the two metal pieces at corresponding positions on a lower mold of an injection mold, such that the upper surfaces of the first soldering portions of the two metal pieces cling to a bottom of the lower mold, and there is a gap from the middle portions of the two metal pieces to the bottom of the lower mold, while the upper surfaces of the second soldering portions of the two metal pieces cling to the bottom of the lower mold, or locating the second soldering portions in a protection structure of the lower mold, to prevent the second soldering portions from being embedded into the silica gel diaphragm;

after injecting the liquid silica gel into the lower mold, press-covering the lower mold with an upper mold of the injection mold; and after hot-press molding the liquid silica gel, removing the upper mold and the lower mold to obtain the silica gel diaphragm.

Preferably, the first soldering portions of the two metal pieces are symmetrically embedded at central positions on the planar portion that are closer to the folded ring portion.

Preferably, upper surfaces of the first soldering portions of the two metal pieces are exposed from a lower surface of the silica gel diaphragm; and when the second soldering portions are embedded into the fixing portion of the silica gel diaphragm, upper surfaces of the second soldering portions of the two metal pieces are exposed from the lower surface of the silica gel diaphragm.

Preferably, one end of the middle portions connecting the first soldering portions and the second soldering portions has the same shape as the shape of the folded ring portion and is embedded into the folded ring portion, and other portions of the middle portions are embedded into the fixing portion of the silica gel diaphragm.

In the technical solution, two metal pieces and the silica gel diaphragm are integrally injection molded, such that the connection between the voice coil and the bonding pad can be achieved by soldering the metal pieces with the voice coil and the bonding pad, respectively, during the assembly of the voice coil. The solution where the voice coil lead wires are replaced by the two metal pieces of the silica gel diaphragm can solve the problem of the poor audition caused by the collision of the voice coil lead wires in traditional solutions. In addition, the metal pieces injection-molded in the silica gel diaphragm do not occupy any extra space, and can avoid the risk of the breakage of the voice coil lead wires, thereby improving the product stability.

In the technical solution, the method for processing a silica gel diaphragm is easy and feasible with a high yield. Compared with traditional techniques such as diaphragm surface electroplating and sputtering, the solution where metal pieces are injection-molded into the silica gel diaphragm has the advantage that the conductive metal layer will not easily be fractured or corroded.

The above descriptions are just summarizations of the technical solutions of the present disclosure, and in order to understand the technical means of the present disclosure more clearly, the specific embodiments of the present disclosure are given as follows.

BRIEF DESCRIPTION OF DRAWINGS

The drawings are intended to provide a further understanding of the present disclosure, and constitute part of the description. The drawings are intended to interpret the present disclosure along with the embodiments of the present disclosure, and do not function to limit the present disclosure. In the drawings.

wherein, 1: planar portion; 2: folded ring portion; 3: fixing portion; 4: first soldering portions; 5: second soldering portions; 6: middle portions; 7: bonding pads; 8: voice coil; and 9: silica gel diaphragm.

DETAILED DESCRIPTION

In the traditional diaphragm shaping method, the voice coil and the bonding pad can only be connected by using outgoing lead wires, and thus the collision of the voice coil lead wires cannot be solved completely. The present disclosure inventively injection-molds metal pieces into a silica gel diaphragm, and connects the bonding pads by using the metal pieces instead of the traditional outgoing voice coil lead wires.

In order to make the objects, the technical solutions and the advantages of the present disclosure clearer, the embodiments of the present disclosure will be described below in further detail in conjunction with the drawings.

Figure 1:
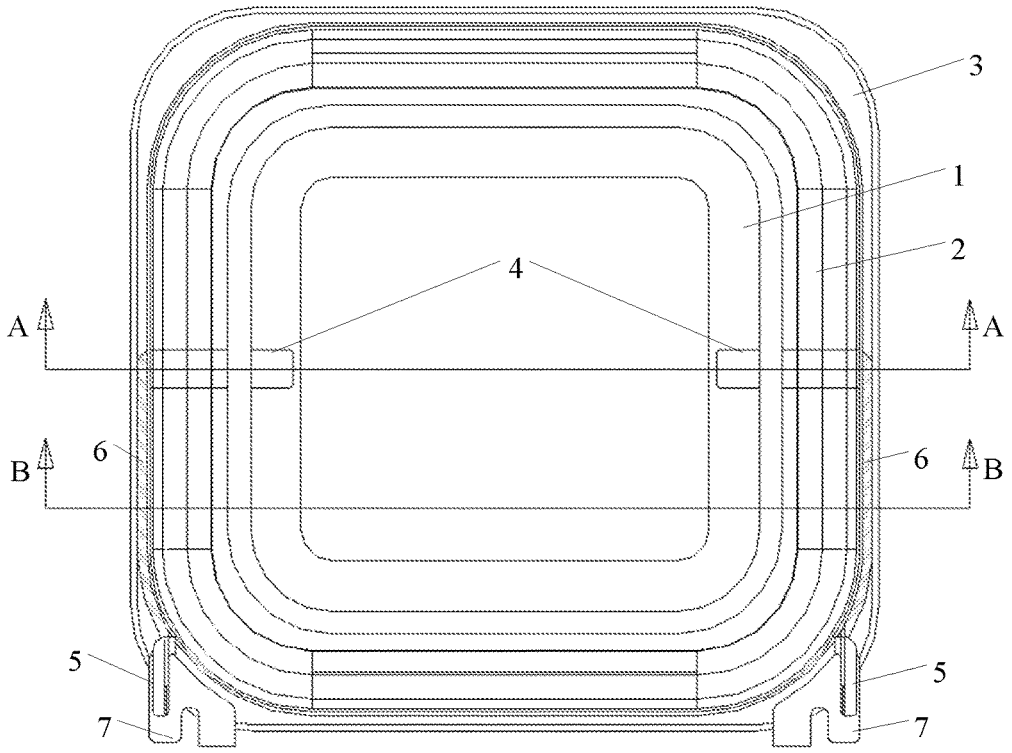
FIG. 1 is a front view of a silica gel diaphragm provided by an embodiment of the present disclosure.
Figure 2:
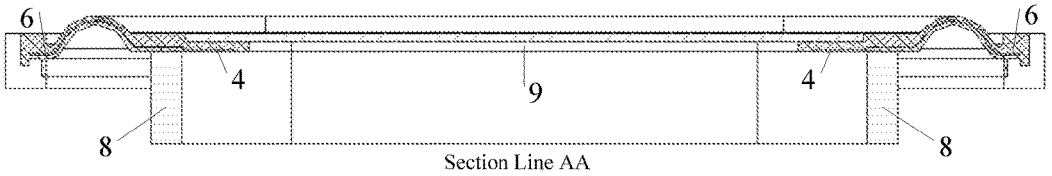
FIG. 2 is a cross-section view of a silica gel diaphragm provided by an embodiment of the present disclosure at the section line AA.
Figure 3:
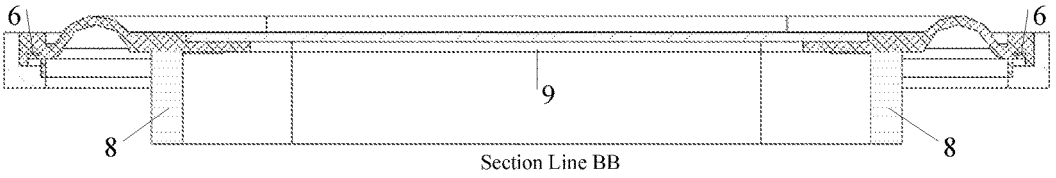
FIG. 3 is a cross-section view of a silica gel diaphragm provided by an embodiment of the present disclosure at the section line BB.

FIG. 1 is a front view of a silica gel diaphragm provided by an embodiment of the present disclosure. The silica gel diaphragm comprises a planar portion 1 located at a center, a folded ring portion 2 disposed at an edge of the planar portion 1, and a fixing portion 3 connected to the periphery of the folded ring portion 2 for bonding a housing.

Two metal pieces are integrally injection-molded on the silica gel diaphragm, and symmetrically embedded into the silica gel diaphragm to avoid any polarization.

Figure 4:
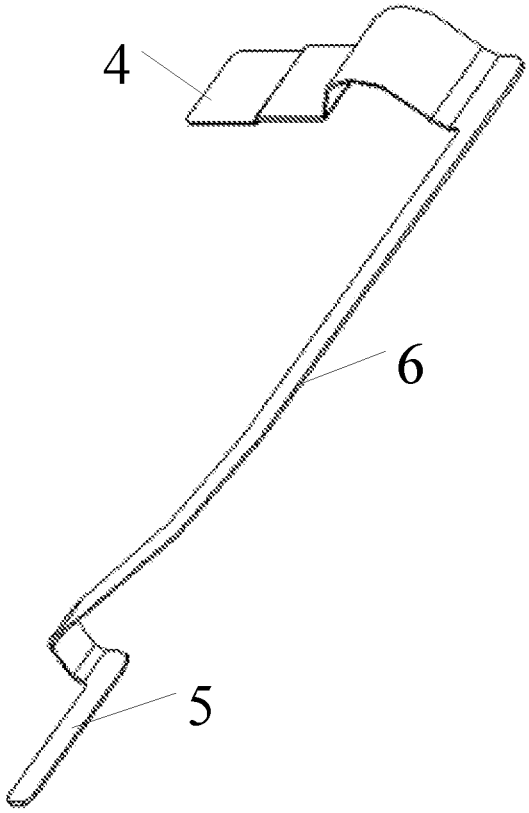
FIG. 4 is a structure view of a metal piece provided by an embodiment of the present disclosure.

FIG. 4 is a structure view of a metal piece provided by an embodiment of the present disclosure. Either end of each of the metal pieces is provided with a first soldering portion 4 and a second soldering portion 5; each first soldering portion 4 is embedded into the planar portion 1 of the silica gel diaphragm that is closer to the folded ring portion 2, and is used for soldering a winding tap of a voice coil on an inner side of the voice coil; each of the second soldering portions 5 protrudes from or is embedded into the fixing portion 3 of the silica gel diaphragm, and is used for soldering a bonding pad on a housing; and middle portions 6 connecting the first soldering portions 4 and the second soldering portions 5 are embedded into the silica gel diaphragm to form an electrically conductive path.

To be noted, FIG. 1 just illustrates that the second soldering portions of the two metal pieces protrude from the fixing portion of the silica gel diaphragm, and the second soldering portions may also be embedded into the fixing portion of the silica gel diaphragm, such as being embedded into the corners of the fixing portion, to facilitate the soldering with the bonding pad on the housing.

In the embodiment, the two metal pieces are integrally injection-molded with the silica gel diaphragm, such that the connection between the voice coil and the bonding pad can be achieved by soldering the metal pieces with the voice coil and the bonding pad, respectively, during the assembly of the voice coil. The solution where the voice coil lead wires are replaced by the two metal pieces of the silica gel diaphragm can solve the problem of the poor audition caused by the collision of the voice coil lead wires in traditional solutions. In addition, the metal pieces injection-molded in the silica gel diaphragm do not occupy any extra space, and can avoid the risk of the breakage of the voice coil lead wires, thereby improving the product stability. The silica gel diaphragm of the embodiment has low manufacturing difficulty and high yield. Compared with traditional techniques such as diaphragm surface electroplating and sputtering, the solution where metal pieces are injection-molded into the silica gel diaphragm has the advantage that the conductive metal layer will not easily be fractured or corroded.

In a preferred solution of the embodiment, as illustrated by FIG. 1, the first soldering portions 4 of the two metal pieces are symmetrically disposed at central positions on the planar portion 1 that are closer to the folded ring portion 2, so as to ensure the balance of the diaphragm and avoid any polarization.

In order to further avoid the polarization of the diaphragm, one end of the middle portion 6 of either metal piece has the same shape as that of the folded ring portion 2 and is embedded into the folded ring portion 2, and the other portions of the middle portions 6 are embedded into the fixing portion 3 of the silica gel diaphragm.

In order to facilitate the soldering of the first soldering portions 4 of the two metal pieces with the winding taps at two ends of the voice coil, the upper surfaces of the first soldering portions 4 are exposed in the embodiment.

Specifically, the upper surfaces of the first soldering portions 4 of the two metal pieces are exposed from a lower surface of the silica gel diaphragm; and when the second soldering portions 5 are embedded into the fixing portion 3 of the silica gel diaphragm, the upper surfaces of the second soldering portions 5 of the two metal pieces are exposed from the lower surface of the silica gel diaphragm.

To be noted, the lower surface of the silica gel diaphragm is the surface of the silica gel diaphragm that is closer to the voice coil, so as to facilitate the soldering of the winding taps of the voice coil with the first soldering portions 4 of the two metal pieces during the assembly of the voice coil.

In order to improve the acoustic performance of the receiver module, and reduce the collision of the voice coil and the amplitude, the embodiment of the present disclosure uses the silica gel diaphragm injection-molded with the metal pieces to replace the traditional solution where the bonding pads are connected by using the outgoing voice coil lead wires, so as to completely solve the problem of the collision of the voice coil lead wires, and reduce the noise of the receiver module.

Specifically, as illustrated by FIGS. 1-4 jointly, the embodiment provides a receiver module, comprising a vibration system received in a housing, wherein the vibration system comprises a diaphragm and a voice coil combined together, wherein the diaphragm is the silica gel diaphragm 9 provided in the above technical solution.

The voice coil 8 is fixed on an inner side of the folded ring portion 2 of the silica gel diaphragm 9; the first soldering portions 4 of the two metal pieces of the silica gel diaphragm 9 are soldered with winding taps at two ends of the voice coil 8, respectively; and the second soldering portions 5 are soldered with two bonding pads 7 on the housing, respectively.

In practical applications, soldering the first soldering portions of the two metal pieces of the silica gel diaphragm with the winding taps at the two ends of the voice coil respectively may be understood as soldering the first soldering portion of one metal piece with the winding tap at one end of the voice coil, and soldering the first soldering portion of the other metal piece with the winding tap at the other end of the voice coil. Soldering the second soldering portions of the two metal pieces of the silica gel diaphragm with the two bonding pads on the housing respectively may be understood as soldering the second soldering portion of one metal piece with the positive electrode side of the bonding pad, and soldering the second soldering portion of the other metal piece with the negative electrode side of the bonding pad.

In the receiver module of the embodiment, the voice coil lead wires in traditional solutions are replaced by the two metal pieces injection-molded in the silica gel diaphragm, such that the first soldering portions of the two metal pieces are soldered with the winding taps on the inner side of the voice coil, and the second soldering portions are soldered with the bonding pads on the housing, thereby not only completely solving the problem of the poor audition caused by the collision of the voice coil lead wires, but also simplifying the process flow, reducing difficulty in manufacturing and assembling, improving the test yield of the receiver module, and increasing the yield of the receiver module.

In practical applications, the housing of the receiver module may comprise an upper housing, a lower housing and an intermediate housing, wherein a cavity enclosed by the upper housing and the lower housing receives the vibration system, and the bonding pads are fixed on the intermediate housing.

Based on the same technical concept as the above silica gel diaphragm, the embodiments of the present disclosure further provide a method for processing a silica gel diaphragm, comprising:

integrally injection-molding liquid silica gel and two metal pieces, which comprise first soldering portions and second soldering portions, such that the two metal pieces are symmetrically embedded into the molded silica gel diaphragm, wherein each of the first soldering portions is embedded into a planar portion of the silica gel diaphragm that is closer to the folded ring portion, and is used for soldering a winding tap of a voice coil on an inner side of the voice coil; each of the second soldering portions protrudes from or is embedded into a fixing portion of the silica gel diaphragm, and is used for soldering a bonding pad on a housing; and middle portions connecting the first soldering portions and the second soldering portions are embedded into the silica gel diaphragm to form an electrically conductive path.

Specifically, the method comprises locating the two metal pieces at corresponding positions on a lower mold of an injection mold, such that the upper surfaces of the first soldering portions of the two metal pieces cling to a bottom of the lower mold, and there is a gap from the middle portions of the two metal pieces to the bottom of the lower mold, while the upper surfaces of the second soldering portions of the two metal pieces cling to the bottom of the lower mold, or locating the second soldering portions in a protection structure of the lower mold, to prevent the second soldering portions from being embedded into the silica gel diaphragm;

after injecting the liquid silica gel into the lower mold, press-covering the lower mold with an upper mold of the injection mold; and after hot-press molding the liquid silica gel, removing the upper mold and the lower mold to obtain the silica gel diaphragm.

In a preferred solution of the embodiment, the first soldering portions of the two metal pieces are symmetrically embedded at central positions on the planar portion that are closer to the folded ring portion, so as to ensure the balance of the diaphragm and avoid any polarization.

In order to further avoid the polarization of the diaphragm, one end of the middle portion connecting the first soldering portion with the second soldering portion has the same shape as that of the folded ring portion and is embedded into the folded ring portion, and other portions of the middle portions are embedded into the fixing portion of the silica gel diaphragm.

In order to facilitate the soldering of the first soldering portions of the two metal pieces with the winding taps at two ends of the voice coil, the upper surfaces of the first soldering portions are exposed in the embodiment.

Specifically, the upper surfaces of the first soldering portions of the two metal pieces are exposed from the lower surface of the silica gel diaphragm; and when the second soldering portions are embedded into the fixing portion of the silica gel diaphragm, the upper surfaces of the second soldering portions of the two metal pieces are exposed from the lower surface of the silica gel diaphragm.

To be noted, the lower surface of the silica gel diaphragm is the surface of the silica gel diaphragm that is closer to the voice coil, so as to facilitate the soldering of the winding taps of the voice coil with the first soldering portion of the two metal pieces during the assembly of the voice coil.

In conclusion, the embodiments of the present disclosure provide a silica gel diaphragm, a receiver module and a method for processing a silica gel diaphragm. Two metal pieces and the silica gel diaphragm are integrally injection molded, such that the connection between the voice coil and the bonding pad can be achieved by soldering the metal pieces with the voice coil and the bonding pad, respectively, during the assembly of the voice coil. The solution where the voice coil lead wires are replaced by the two metal pieces of the silica gel diaphragm can solve the problem of the poor audition caused by the collision of the voice coil lead wires in traditional solutions. In addition, the metal pieces injection-molded in the silica gel diaphragm do not occupy any extra space, and can avoid the risk of the breakage of the voice coil lead wires, thereby improving the product stability. The silica gel diaphragm of the technical solution has low manufacturing difficulty and high yield. Compared with traditional techniques such as diaphragm surface electroplating and sputtering, the solution where metal pieces are injection-molded into the silica gel diaphragm has the advantage that the conductive metal layer will not easily be fractured or corroded.

The above descriptions are merely preferable embodiments of the present disclosure, and are not limiting the protection scope of the present disclosure. Any modifications, equivalent substitutions or improvements that are made within the spirit and principle of the present disclosure are all included in the protection scope of the present disclosure.

What is claimed is:

1. A silica gel diaphragm, comprising a planar portion located at a center, a folded ring portion disposed at an edge of the planar portion, and a fixing portion connected to the periphery of the folded ring portion for bonding a housing, wherein two metal pieces are integrally injection-molded on the silica gel diaphragm, and symmetrically embedded into the silica gel diaphragm, and either end of each of the metal pieces is provided with a first soldering portion and a second soldering portion; and each of the first soldering portions is embedded into the planar portion of the silica gel diaphragm that is closer to the folded ring portion, and is used for soldering a winding tap of a voice coil on an inner side of the voice coil; each of the second soldering portions protrudes from or is embedded into the fixing portion of the silica gel diaphragm, and is used for soldering a bonding pad on the housing; middle portions of the metal pieces connecting the first soldering portions and the second soldering portions are embedded into the silica gel diaphragm to form an electrically conductive path.

2. The silica gel diaphragm according to claim 1, wherein the first soldering portions of the two metal pieces are symmetrically disposed at central positions on the planar portion that are closer to the folded ring portion.

3. The silica gel diaphragm according to claim 1, wherein upper surfaces of the first soldering portions of the two metal pieces are exposed from a lower surface of the silica gel diaphragm; and when the second soldering portions are embedded into the fixing portion of the silica gel diaphragm, upper surfaces of the second soldering portions of the two metal pieces are exposed from the lower surface of the silica gel diaphragm.

4. The silica gel diaphragm according to claim 1, wherein one end of the middle portions has the same shape as the shape of the folded ring portion and is embedded into the folded ring portion, and other portions of the middle portions are embedded into the fixing portion of the silica gel diaphragm.

5. A receiver module, comprising a vibration system received in a housing, wherein the vibration system comprises a silica gel diaphragm and a voice coil combined together, the silica gel diaphragm includes a planar portion located at a center, a folded ring portion disposed at an edge of the planar portion, and a fixing portion connected to the periphery of the folded ring portion for bonding the housing, wherein two metal pieces are integrally injection-molded on the silica gel diaphragm, and symmetrically embedded into the silica gel diaphragm, and either end of each of the metal pieces is provided with a first soldering portion and a second soldering portion; and each of the first soldering portions is embedded into the planar portion of the silica gel diaphragm that is closer to the folded ring portion, and is used for soldering a winding tap of the voice coil on an inner side of the voice coil; each of the second soldering portions protrudes from or is embedded into the fixing portion of the silica gel diaphragm, and is used for soldering a bonding pad on the housing; middle portions of the metal pieces connecting the first soldering portions and the second soldering portions are embedded into the silica gel diaphragm to form an electrically conductive path; and the voice coil is fixed on an inner side of the folded ring portion of the silica gel diaphragm; the first soldering portions of the two metal pieces of the silica gel diaphragm are soldered with winding taps at two ends of the voice coil, respectively; and the second soldering portions of the two metal pieces are soldered with two bonding pads on the housing, respectively.

6. The receiver module according to claim 5, wherein the first soldering portions of the two metal pieces are symmetrically disposed at central positions on the planar portion that are closer to the folded ring portion.

7. The receiver module according to claim 5, wherein upper surfaces of the first soldering portions of the two metal pieces are exposed from a lower surface of the silica gel diaphragm; and when the second soldering portions are embedded into the fixing portion of the silica gel diaphragm, upper surfaces of the second soldering portions of the two metal pieces are exposed from the lower surface of the silica gel diaphragm.

8. The receiver module according to claim 5, wherein one end of the middle portions has the same shape as the shape of the folded ring portion and is embedded into the folded ring portion, and other portions of the middle portions are embedded into the fixing portion of the silica gel diaphragm.

9. A method for processing a silica gel diaphragm, comprising:

integrally injection-molding liquid silica gel and two metal pieces, which comprise first soldering portions and second soldering portions, such that the two metal pieces are symmetrically embedded into the molded silica gel diaphragm, wherein each of the first soldering portions is embedded into a planar portion of the silica gel diaphragm that is closer to a folded ring portion, and is used for soldering a winding tap of a voice coil on an inner side of the voice coil; each of the second soldering portions protrudes from or is embedded into a fixing portion of the silica gel diaphragm, and is used for soldering a bonding pad on a housing; and middle portions of the metal pieces connecting the first soldering portions and the second soldering portions are embedded into the silica gel diaphragm to form an electrically conductive path.

10. The method according to claim 9, wherein the integrally injection-molding liquid silica gel and two metal pieces, which comprise the first soldering portions and the second soldering portions comprises:

locating the two metal pieces at corresponding positions on a lower mold of an injection mold, such that upper surfaces of the first soldering portions of the two metal pieces cling to a bottom of the lower mold, and there is a gap from the middle portions of the two metal pieces to the bottom of the lower mold, while upper surfaces of the second soldering portions of the two metal pieces cling to the bottom of the lower mold, or locating the second soldering portions in a protection structure of the lower mold, to prevent the second soldering portions from being embedded into the silica gel diaphragm;

after injecting the liquid silica gel into the lower mold, press-covering the lower mold with an upper mold of the injection mold; and after hot-press molding the liquid silica gel, removing the upper mold and the lower mold to obtain the silica gel diaphragm.

11. The method according to claim 9, wherein the first soldering portions of the two metal pieces are symmetrically embedded at central positions on the planar portion that are closer to the folded ring portion.

12. The method according to claim 9, wherein upper surfaces of the first soldering portions of the two metal pieces are exposed from a lower surface of the silica gel diaphragm;

when the second soldering portions are embedded into the fixing portion of the silica gel diaphragm, upper surfaces of the second soldering portions of the two metal pieces are exposed from the lower surface of the silica gel diaphragm.

13. The method according to claim 9, wherein one end of the middle portions has the same shape as the shape of the folded ring portion and is embedded into the folded ring portion, and other portions of the middle portions are embedded into the fixing portion of the silica gel diaphragm.

* * * * *